US008899141B2

(12) United States Patent
Reynolds et al.

(10) Patent No.: US 8,899,141 B2
(45) Date of Patent: Dec. 2, 2014

(54) RATE CONTROL MECHANISM

(71) Applicants: George L. Reynolds, Altona, IL (US); S. Paul Reynolds, Galesburg, IL (US)

(72) Inventors: George L. Reynolds, Altona, IL (US); S. Paul Reynolds, Galesburg, IL (US)

(73) Assignees: George L. Reynolds, Altona, IL (US); S. Paul Reynolds, Altona, IL (US)

( * ) Notice: Subject to any disclaimer, the term of this patent is extended or adjusted under 35 U.S.C. 154(b) by 106 days.

(21) Appl. No.: 13/768,614

(22) Filed: Feb. 15, 2013

(65) Prior Publication Data

US 2014/0230642 A1 Aug. 21, 2014

(51) Int. Cl.
*F41A 3/54* (2006.01)
*F41A 5/12* (2006.01)

(52) U.S. Cl.
CPC ..... *F41A 5/12* (2013.01)
USPC ..... 89/130; 89/129.01; 89/129.02

(58) Field of Classification Search
USPC ..... 89/129.01, 129.02, 130, 131, 182, 89/187.01; 42/71.01, 72, 74, 97
See application file for complete search history.

(56) References Cited

U.S. PATENT DOCUMENTS

| | | | | |
|---|---|---|---|---|
| 1,464,276 | A * | 8/1923 | Vincon | 89/131 |
| 2,167,672 | A | 8/1939 | Nomar | |
| 2,379,561 | A | 7/1945 | Simpson | |
| 2,809,564 | A | 10/1957 | Pope | |
| 2,834,257 | A | 5/1958 | Garand | |
| 3,650,177 | A * | 3/1972 | Hupp et al. | 89/130 |
| 3,724,325 | A * | 4/1973 | Silsby | 89/131 |
| 4,028,993 | A | 6/1977 | Reynolds | |
| 4,057,003 | A | 11/1977 | Atchisson | |
| 4,269,109 | A | 5/1981 | Stoner | |
| 5,909,002 | A | 6/1999 | Atchisson | |
| 6,848,351 | B1 | 2/2005 | Davies | |
| 8,001,881 | B2 | 8/2011 | Sy | |

* cited by examiner

*Primary Examiner* — Bret Hayes
*Assistant Examiner* — Derrick Morgan
(74) *Attorney, Agent, or Firm* — Krieg DeVault LLP

(57) ABSTRACT

Certain embodiments disclose rate reducer systems and methods to reduce the cyclic rate of self-powered firearms. The reduction in cyclic rate is achieved by mechanically delaying the firing step in the cycle of functioning. This delay is achieved by temporarily latching an inertia weight at the rear of the recoil stroke while the recoiling parts return to battery (i.e. a firing position). When the recoiling parts go into battery, the inertia weight is released and urged forward. At the forward end of its travel, the inertia weight actuates the firing mechanism.

20 Claims, 13 Drawing Sheets

RATE CONTROL MECHANISM

BACKGROUND OF THE INVENTION

All self-powered firearms have a natural cyclic rate. The natural cyclic rate of each firearm is a function of its design so the natural cyclic rate is merely an outcome of the design. Unfortunately, the natural cyclic rate of a firearm may not be the optimum cyclic rate for the target engagement scenarios most commonly encountered. Generally speaking, the natural cyclic rate of firearms intended for antipersonnel use is far higher than would be optimum. The cyclic rate of a firearm is usually expressed as the number of Shots Per Minute (spm) that the firearm would discharge when fired in the fully automatic mode, although in actual practice firearms are seldom fired continuously for one minute.

Most shoulder-fired fully automatic firearms such as the M16 family of rifles and the M4 family of carbines have such high natural cyclic rates of fire that the rapidly delivered recoil impulses to the shooter cause the weapon to move off target uncontrollably. This not only reduces hit probability, but wastes ammunition, overheats and rapidly wears out mechanical aspects such as barrels, can cause a serious safety hazard to fellow soldiers and bystanders, and reduces "trigger time" for the available ammunition. In most cases this pervasive uncontrollability is simply tolerated and/or somewhat mitigated by training soldiers to fire short bursts or by incorporating burst limiters within the firearm mechanism. On the other hand, a way of actually improving controllability is to reduce the cyclic rate.

The M16/M4 families of firearms possess a natural cyclic rate of fire of 700 to 950 spm. When fired from the offhand position in fully automatic fire by experienced (right handed) shooters, controllability testing has shown that at 100 yards the second projectile of a burst strikes approximately one foot to the right and above the impact of the first projectile, and the third projectile strikes approximately two feet to the right and above the second projectile (three feet off target). Furthermore it takes until about the seventh round of a burst before the shooter can force the shots back approximately onto target. Then when the trigger is released, the firearm plunges down and to the left (down and to the right for a left handed shooter). This makes target reacquisition time consuming/difficult.

The M4 family of carbines is physically lighter than the M16 family of rifles, making the M4 even less controllable. The uncontrollability of the M4 Carbine (which is typical of current military rifles and carbines) in full automatic fire also contributes to wastage of ammunition, excess barrel heating, etc. Rifles having heavier recoil than the 5.56 mm NATO Cartridge (such as those chambered for 7.62 mm NATO) greatly exacerbate the controllability problem.

In order to ameliorate the waste of ammunition, the M4 and some other variants of the M16 are equipped with a three round burst limiter. Three round burst limiters do not so much provide increased hit probability, but rather provide more trigger time/pulls per magazine.

Some rate reducers lower the natural cyclic rate by slowing the average velocity of the recoiling parts through the use of hydraulic buffering. The amount of rate reduction achievable using hydraulic buffers is limited because the recoiling parts themselves are slowed, and the firearm cannot function at all below a certain operating mechanism velocity. This is because the minimum amount of momentum required to carry the recoiling parts through the cycle of functioning is lost. The term "recoiling parts" is applied to those parts of the firearm mechanism (such as the bolt, bolt carrier, etc.) that travel from battery to full recoil (and back) during the cycle of functioning. The term applies to those parts whether the parts are actually moving in recoil or in counter recoil, toward battery.

The U.S. military, as well as civilian industry, have developed several hydraulically based rate reducing mechanisms for the M16/M4 family of weapons; however, hydraulic rate control mechanisms do not achieve an effective reduction in cyclic rate. In these systems the bolt carrier is brought more slowly to a stop in recoil. While this slowing results in somewhat reducing the cyclic rate, it also results in reduced functional reliability because energy is removed that is required for reliably cycling the mechanism. Additionally, hydraulic buffers react unfavorably to extreme hot and cold environments; delivering less rate reduction in high temperature environments and being sluggish at cold temperatures. The largest disadvantage, however, with hydraulic systems is their inherent inability to adequately reduce the cyclic rate sufficiently to substantially increase hit probability.

SUMMARY

In certain embodiments, a method is disclosed for reducing the cyclic rate of a self-powered firearm. The method includes allowing a timing group assembly to travel rearward relative to a pull rod within a receiver extension of a self-powered firearm upon an initial recoil action. An inertia weight of the timing group assembly is retained at a rearward position within the receiver extension while disengaging the inertia weight from the remainder of the timing group. The remainder of the timing group is urged to travel forward relative to the pull rod, causing the pull rod to advance and to disengage the inertia weight from the rearward end of the receiver extension. The disengaged inertia weight is urged to travel forward within the receiver extension; and, allowed to travel forward to an impact position wherein the inertia weight communicates force forward sufficient to actuate a sear to fire the firearm.

In an alternate embodiment, an assembly includes a timing group having an inertia weight arranged within a receiver extension of a self-powered firearm. A pull rod is arranged within the receiver extension. The timing group can selectively translate rearward relative to the pull rod during a recoil stage of the firearm. A weight latch mechanism retains the inertia weight of the timing group at a rearward position within the receiver extension while disengaging the inertia weight from the remainder of the timing group. A drive biasing element urges the remainder of the timing group to travel forward relative to the pull rod at the end of the recoil stage. The timing group impacts a forward end of the pull rod during forward movement, causing the pull rod to move forward. The pull rod includes a rear portion which causes the weight latch mechanism to disengage the inertia weight from the rearward end of the receiver extension when the pull rod moves forward. A weight biasing element urges the disengaged inertia weight to move forward to an impact position to communicate force forward to actuate a sear to fire the firearm.

In certain embodiments, a self-powered firearm incorporates a cyclic rate reduction assembly. The assembly comprises a self-powered firearm having a receiver extension and having a sear element which can be tripped to fire the firearm during automatic fire. A timing group is initially arranged within a forward portion of the receiver extension and has an inertia weight. The timing group can translate rearwardly against a drive biasing element during a recoil stage of the firearm. A pull rod is arranged within the receiver extension.

A latch mechanism is arranged to retain the inertia weight at a rearward position within the receiver extension while disengaging the inertia weight from the remainder of the timing group and the biasing element urges the remainder of the timing group to translate forward without the inertia weight. The timing group impacts a forward end of the pull rod during the forward movement, whereupon the pull rod translates force to a rear portion which disengages the latch mechanism. A weight biasing element urges the inertia weight to move forward sufficiently to communicate force forward to trip the sear.

In certain embodiments, the rate reducer assembly is selectively controllable or adjustable by varying the inertia weight's mass and the load applied by its spring, and therefore can be adjusted to a desired cyclic rate. In selected embodiments, the rate reducer assembly may optionally add an axial rotation and/or oscillating motion to the linear movement of the inertia weight as the inertia weight moves toward battery. The amount of axial motion added can be selectively configured to control the cyclic rate.

Additional objects and advantages of the described embodiments are apparent from the discussions and drawings herein.

DESCRIPTION OF PREFERRED EMBODIMENTS

Figure 1:
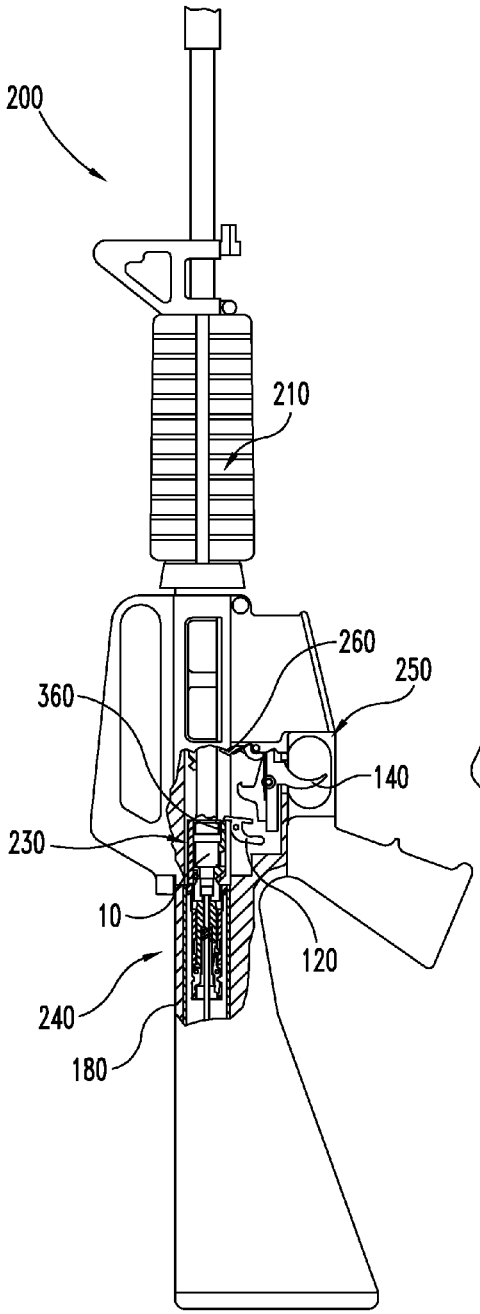
FIG. 1 is a cut-away right side view of an M16/M4 type firearm with all components, including rate reducer components, in the fired position.

For the purposes of promoting an understanding of the principles of the disclosure, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated, as would normally occur to one skilled in the art to which the invention relates.

Embodiments of the present disclosure incorporate a "rate reducer," namely a cyclic rate reducing mechanism applicable to the M16/M4 family of weapons in particular. While described in the context of an M16/M4 type of system, the rate reducer can be readily scaled to be applicable for larger caliber M16 style firearms, as well as being applicable to other weapons employing similar operating systems, and which have undesirably high cyclic rates of fire.

Certain embodiments of the rate reducer reduce the cyclic rate of a self-powered firearm, such as an M16/M4 type system, by interrupting the firing portion of the cycle itself, rather than merely slowing the recoiling parts. Aspects of the described mechanical rate reducer permit the recoiling parts to function essentially at their natural recoil and counter recoil velocities. The recoiling parts open and close as they are normally designed to do, so reliability is not affected. The reduction in cyclic rate is achieved by mechanically delaying the firing step in the cycle of functioning. This delay is achieved by temporarily latching an inertia weight at the rear of the recoil stroke while the recoiling parts return to battery (i.e. a firing position).

Broadly described, during the final forward movement of the recoiling parts going into battery in a firing cycle, an inertia weight is released and urged forward by a relatively low force spring. At the forward end of its travel, the inertia weight actuates the firing mechanism. The amount of cyclic rate reduction is determined by the mass of the inertia weight and the load applied by its spring. The rate reducer mechanism's design is selectively "controllable" or "adjustable" by varying the inertia weight's mass and the load applied by its spring, and therefore can be adjusted to an optimum cyclic rate for a specific context of use.

Inertia weights have been previously used in other types of rate reducing mechanisms, such as in the M1918A2 Browning Automatic Rifle. Inertia weights are also used in the rate reducers employed in the M73 and M85 Machineguns, as well as the Czech Skorpion (sic) vz 61 submachine gun. However, the mechanisms in each of these weapons are each substantially different from the present rate reducer.

In certain embodiments, the rate reducer uses a pull rod to actuate the inertia weight/timing group before the rate reducing delay has occurred. The pull rod and associated parts (which are symmetrically loaded), contribute to being able to open the rifle in the normal manner. Symmetrical loading, as opposed to cantilevered loading, is desirable in any mechanism in order to reduce friction.

Aspects of certain embodiments use latches which prevent the inertia weight from separating from the buffer due to primary recoil. This insures that the inertia weight and buffer are in contact with each other when the bolt carrier and buffer are accelerated rearward by the gas system. Otherwise the buffer and inertia weight may impact each other (on the rearward stroke) and the subsequent energy/momentum loss would detrimentally affect reliability. Further, latching the inertia weight to the buffer ensures that the timing group/transfer button will be held in the firing position, regardless of whether or not the carrier group goes into battery with sufficient energy to allow the inertia weight to actuate the sear. That is, it is necessary to ensure that the rifle's sear will always be actuated when the carrier group is in the battery position. The buffer latches ensure that, despite suffering a "short-cycle" malfunction (or one of several other scenarios, that would result in the hammer being cocked but the inertia weight not being released from its rearward position with sufficient momentum to actuate the sear), the sear pusher (via the transfer button/inertia weight) will be held forward (in the fire position) to actuate the sear, without relying on the inertia weight's momentum alone. Although latches are preferred, certain embodiments may operate without latches, with a suitable spring selection. In such embodiments, a movable pull rod is not required, but may still be desirable as a guide mechanism.

The rate reducer may include two major assemblies: first, a bolt carrier group modified so that it does not directly/immediately trip the automatic sear as the bolt carrier moves forward; and, second, a timing group that replaces the standard M16 style buffer assembly and is housed in the lower receiver extension of the firearm. The timing group replaces the mass and length of a standard buffer to maintain an appropriate recoiling mass and operating stroke. The timing group also delays actuation of the automatic sear via an inertia weight that is latched to the rear as the timing group recoils. The inertia weight is held rearward until the timing group moves forward. When the inertia weight is released, its spring urges it forward to an impact position where it trips the automatic sear by force transfer via the transfer button and sear pusher.

Advantages of certain embodiments, for example usable in M16 style of firearms, are that the rate reducer mechanism may be "dropped in" to place; that is, the original bolt carrier and buffer are removed (as in field stripping) and a rate reducer as disclosed herein may be substituted. This allows use of a rate reducer mechanism herein in M16 style of firearms which pivot open in the middle for field stripping and cleaning, thereby complicating communication between the space available for the rate reducer, and the trigger mechanism (which the rate reducer must actuate). In certain of these embodiments, the rate reducer incorporates a transfer button and a sear pusher which serve as a transfer/communication unit. This transfer unit permits M16 type firearms to be opened/closed (for field stripping, etc.) in the normal manner while providing seamless engagement and disengagement of the rate reducer components.

In certain embodiments, the rate reducer is compatible with burst limiters, such as the three round burst limiter of the M16/M4 Carbine. Preferably, the rate reducer will substantially increase the hit probability of the second and third shots of the bursts.

References to "forward" herein are intended to mean the direction of travel of the projectile out of the front end of a barrel from the perspective of a firearm user. Directional references are for convenience and are not intended to be limiting. A small amount of friction in the systems according to various embodiments exists and is acknowledged, but friction can be ignored for purposes of the embodiments and disclosure herein.

FIG. 1 is a partial cut-away right side view of an M16 type self-powered firearm 200 with the recoiling parts and the rate reducer parts fully in battery and in the fired position, with sear 120 having been rotated clockwise by projection 360 of sear pusher 10. Firearm 200 includes an upper receiver assembly 210 and lower receiver assembly 250. The trigger assembly in firearm 200 includes trigger 140, hammer 260 and automatic sear 120.

Figure 2:
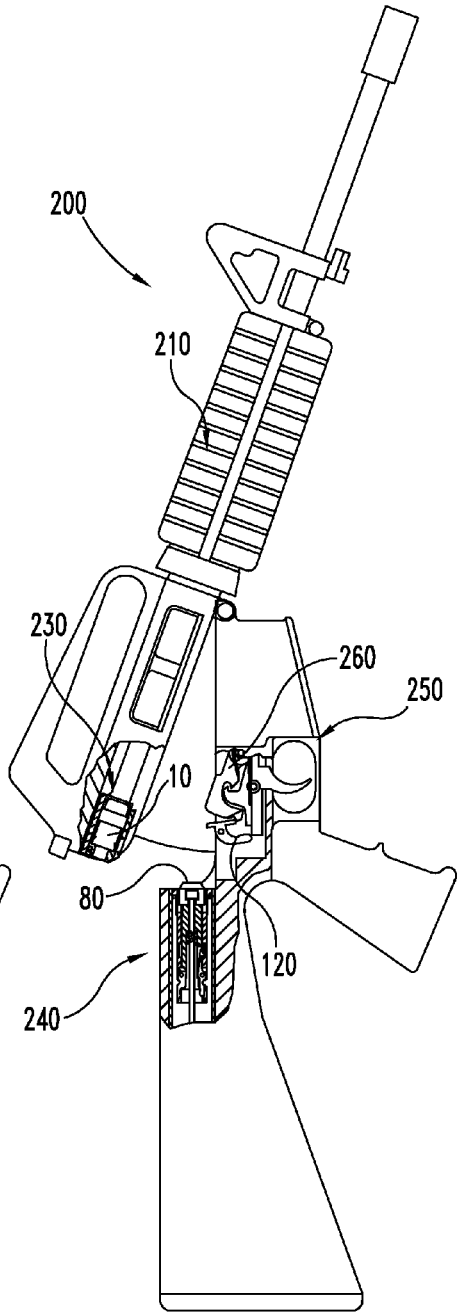
FIG. 2 is a cut-away right side view of the firearm of FIG. 1 pivoted open for field stripping.

FIG. 2 illustrates firearm 200 pivoted open preparatory to field stripping which would allow removal of bolt carrier group assembly 230 and timing group assembly 240. In the open position, pusher 10 of bolt carrier group 230 has been pivoted out of contact with transfer button 80. Sear pusher 10 is spring loaded toward transfer button 80, such that when firearm 200 is closed, they will reengage into place as shown in FIG. 1.

Figure 3:
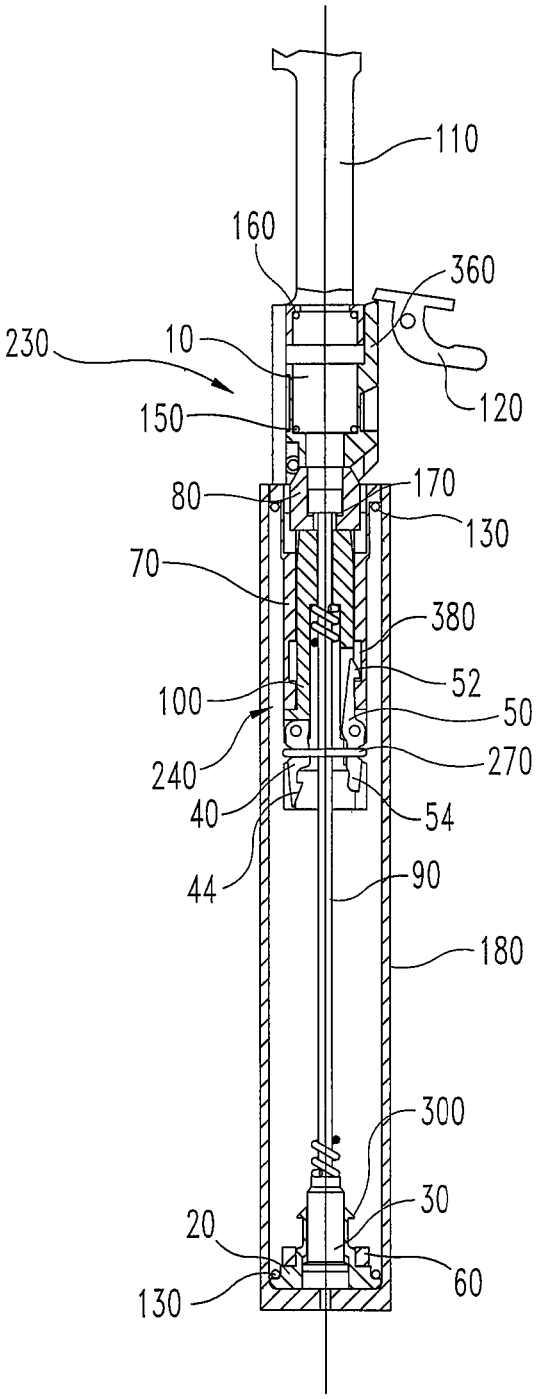
FIG. 3 is a partial section side view of a bolt carrier group and rate reducer components from a firearm such as shown in FIG. 1 fully in battery and in the fired position.

FIG. 3 illustrates a fully visible detailed view of the timing group 240 and bolt carrier group 230 usable in a firearm 200 as shown in FIG. 1. FIG. 3 illustrates the point in the firing cycle where the firearm has just been fired, but the operating system of the firearm has not yet had time to begin accelerating the recoiling parts to the rear. At this point in the cycle, inertia weight 100 is coupled to buffer 70, for example with a portion of weight 100 received within an internal cavity of buffer 70. In the illustrated example, the forward end 52 of buffer latch 50 is engaged with internal annular recess 380 in buffer 70, for example using a radially outward facing hooking or detent mechanism which engages an inward facing recess 380 defined on the inner diameter of buffer 70. Buffer latch 50 and weight latch 40 are pivotally mounted to inertia weight 100 and the rearward ends 54 and 44 are biased radially inward by the hoop force of a circular spring 270 which encircles weight 100. In certain embodiments, an example circular spring 270 may be an elastomer band or any other type of biasing element.

When buffer latch 50 is engaged with annular recess 380 in buffer 70, inertia weight 100 is prevented from accelerating away from buffer 70. When buffer 70 and inertia weight 100 move sharply rearward in primary recoil (in reaction to launching the projectile), inertia weight 100 and buffer 70 are kept together. Additionally, latching buffer 70 to inertia weight 100 ensures that automatic sear 120 will be reliably actuated when bolt carrier group 230 and timing group 240 are fully in the battery position, regardless of how quickly the firearm mechanism is cycled.

For clarity, the drawings show only one weight latch 40 and one buffer latch 50 (for example displaced 180 degrees from each other). In practice the rate reducer is optionally yet preferably provided with two weight latches and two buffer latches with the pairs of latches displaced opposite from each other. Optionally and space permitting, more than two weight latches and buffer latches could be used, preferably in a balanced spacing around buffer 70. This provides (in practice) symmetric and/or balanced loading of the latches (and associated parts) to minimize friction, and enhances functional reliability.

Figure 6:
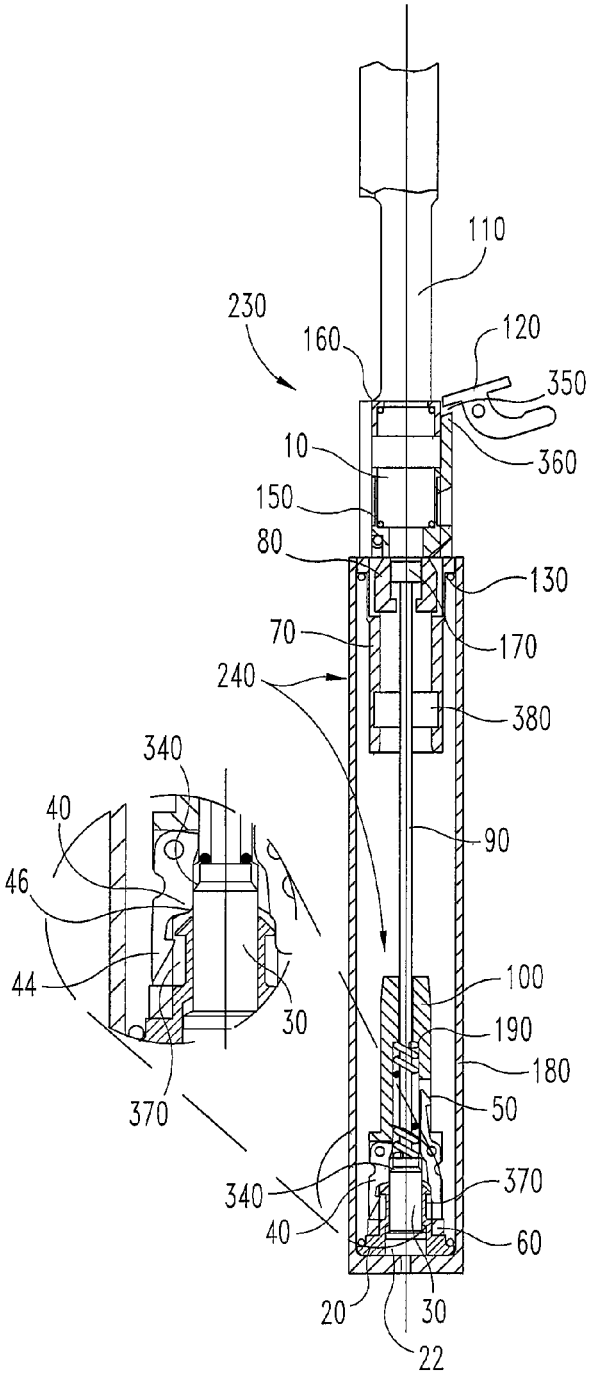
FIG. 6 is a partial section side view of the bolt carrier and rate reducer components of FIG. 3 showing the bolt carrier group fully in battery, with the inertia weight latches released, but the inertia weight has not started moving forward.
Figure 6D:
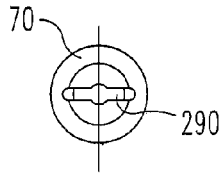
FIG. 6D is a front view of the buffer from FIG. 3.
Figure 6C:
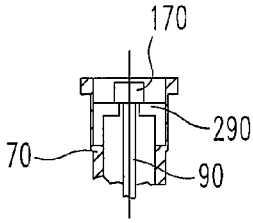
FIG. 6C shows the buffer and pull rod from FIG. 3 in their positions as they would be with the recoiling parts fully in battery.
Figure 6B:
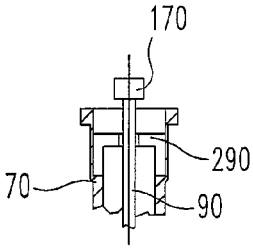
FIG. 6B shows the buffer and pull rod from FIG. 3 in their positions as they would be with the recoiling parts out of battery.
Figure 6A:
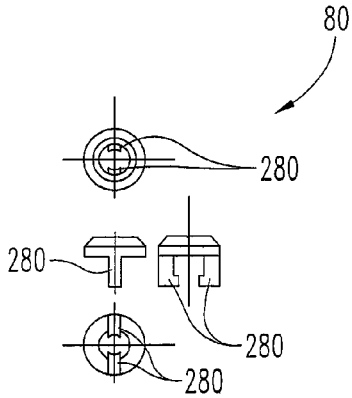
FIG. 6A shows the transfer button from FIG. 3 in four views.
Figure 7:
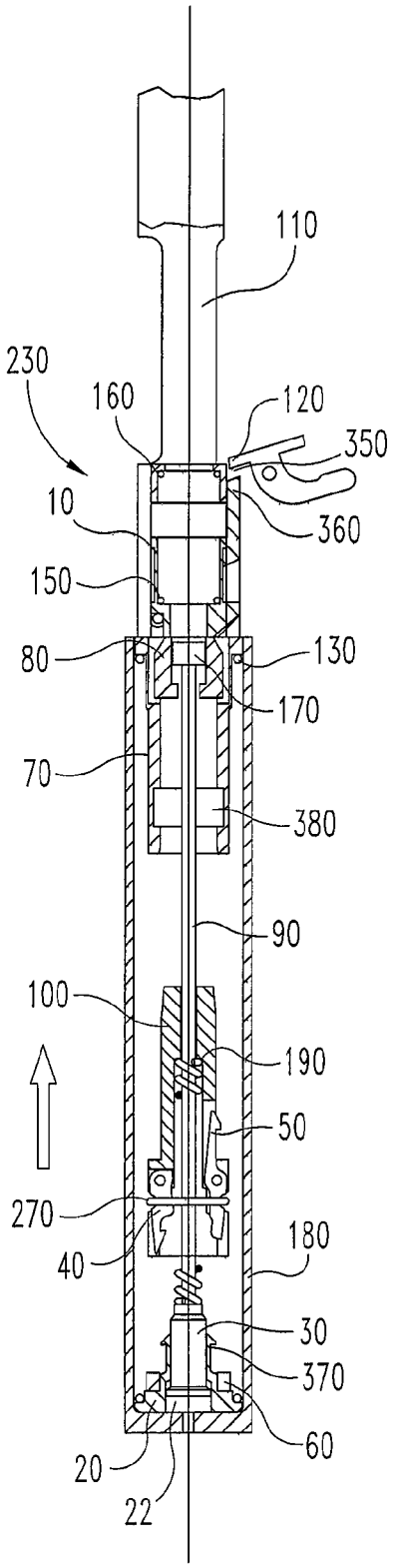
FIG. 7 shows the bolt carrier group of FIG. 3 fully in battery and the inertia weight moving forward.
Figure 8:
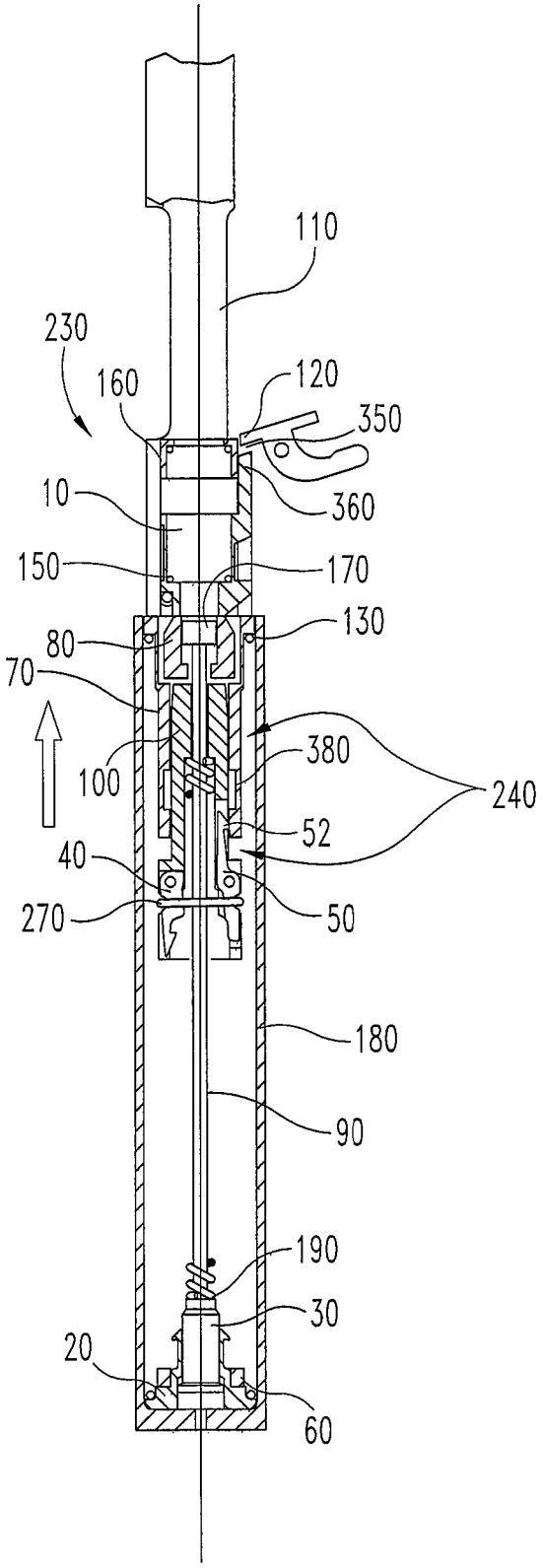
FIG. 8 shows the bolt carrier group of FIG. 3 fully in battery, with the inertia weight moving forward, but the inertia weight not yet having impacted the transfer button.

In conventional M16 type firearms the bolt carrier going forward into battery trips the automatic sear 120 during automatic fire. In the illustrated embodiment of the rate reducer, projection 360 of sear pusher 10 trips automatic sear 120, but not at the instant bolt carrier 110 goes into battery. Specifically, when bolt carrier group 230 goes into battery sear pusher projection 360 does not reach automatic sear 120, thus the firearm does not yet fire. Since sear pusher 10 and transfer button 80 possess inertia when they slam forward into battery, it is necessary to prevent them from tripping automatic sear 120 from their own momentum. In the present embodiments, as illustrated in FIGS. 6, 7 and 8, when sear pusher 10 is in its pre-actuation forward position a gap 350 is arranged between projection 360 and automatic sear 120.

When the bolt carrier group 230 slams into battery, pusher spring 150 applies sufficient rearward force against pusher 10 (and indirectly to transfer button 80) to prevent projection 360 of sear pusher 10 from contacting and tripping automatic sear 120. Pusher spring 150 is compressibly arranged between a spring seat 160 on the bolt carrier group and the rear of pusher 10 of bolt carrier group 230. Specifically, spring seat 160 stops at a forward position and the momentum of sear pusher 10 is then absorbed by compression of pusher spring 150. A cross-section section of a forward-most coil and a rearward coil of pusher spring 150 are illustrated, intermediate coils are not illustrated to enable better viewing of other illustrated aspects.

Figure 4:
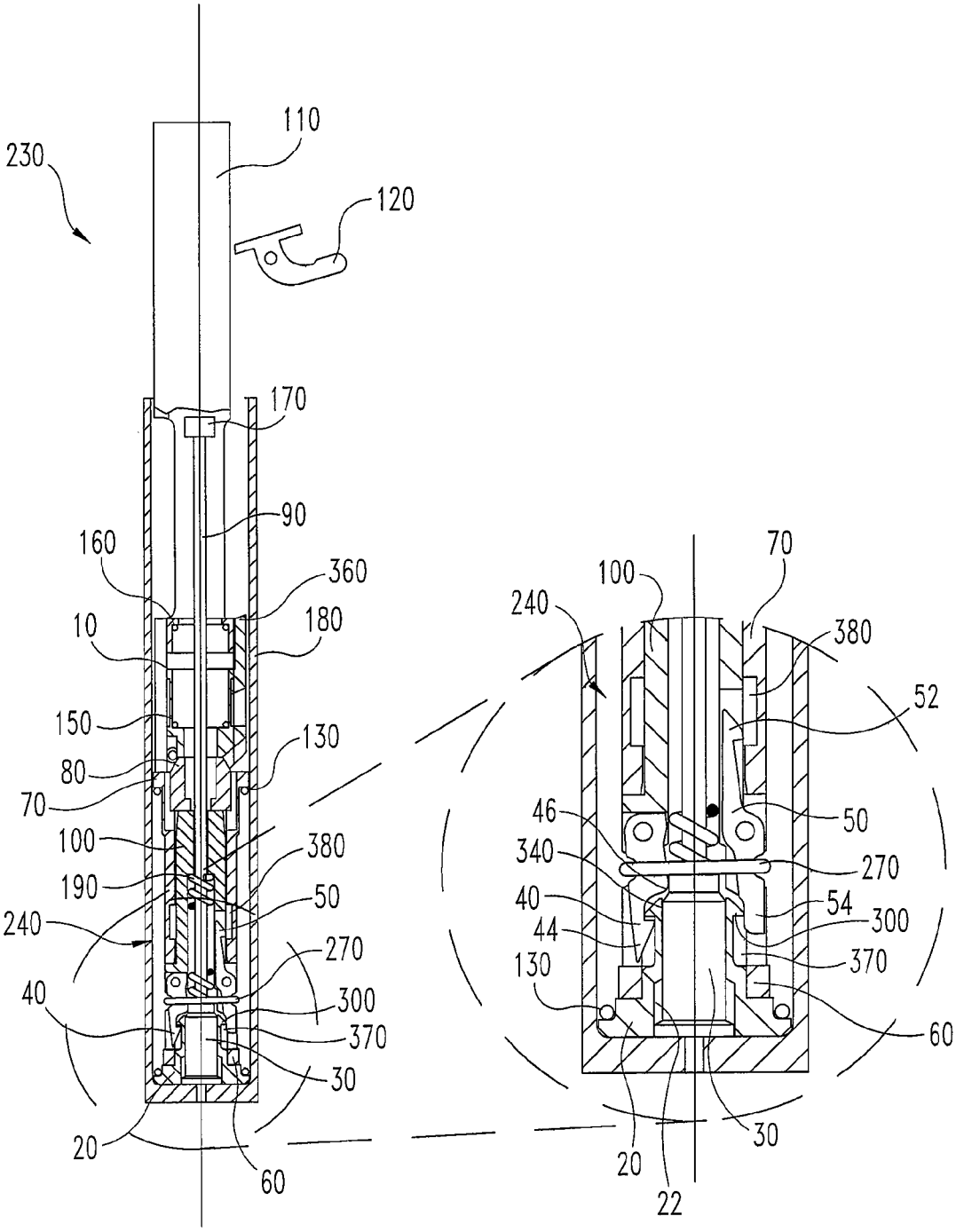
FIG. 4 is a partial section side view showing the rate reducer components of FIG. 3 in full recoil.

FIG. 4 illustrates the bolt carrier group 230 and timing group 240 of FIG. 3 shown at the instant of full recoil. Bolt carrier group 230 and timing group 240 translated rearward along pull rod 90. As the bolt carrier group 230 and timing group 240 began moving rearward within receiver extension 180, the rear pull rod head 30 was pushed rearward by inertia weight spring 190, moving pull rod 90 slightly rearward relative to base plate 20. The rear portion of inertia weight 100 impacts a force absorbing portion, such as nylon ring 60, for example mounted to base plate 20. Nylon ring 60 preferably substantially absorbs the impact of the recoiling parts.

A drive biasing element such as drive or action spring 130 is arranged between base plate 20 at the rear of the receiver extension 180 and the timing group 240. As illustrated the forward end of drive spring 130 is arranged to abut a shoulder defined by buffer 70. Drive spring 130 may be a coil spring. A cross-section section of a forward-most coil and a rearward coil of drive spring 130 are illustrated in FIGS. 3-6 and 7-8, intermediate coils are not illustrated to enable better viewing of other illustrated aspects. As timing group 240 with buffer 70 moves rearwardly, it compresses drive spring 130.

At the recoil/rearward position, weight latch 40 of inertia weight 100 engages a recess such as annular groove 370 in base plate 20, to retain inertia weight 100 at the rearward position within the receiver extension 180. Further, abutment of rear end 54 against contact point 300 of base plate 20 actuates buffer latch 50, causing buffer latch 50 to pivot counterclockwise (from the illustrated perspective) so that forward end 52 releases/disengages weight 100 from buffer 70 and the remainder of the timing group 240. The bolt carrier group 230 and the remainder of the timing group 240 are now free to be driven toward battery by drive spring 130. The arrangement of weight latch 40 and buffer latch 50 are such that inertia weight 100 cannot be latched to base plate 20 and to buffer 70 at the same time. Still further, during the rearward motion of inertia weight 100, an inertial weight spring 190 which is coiled around pull rod 90 is compressed between inertia weight 100 and rear pull rod head 30.

After full recoil, buffer 70 and bolt carrier group 230 are not retained at the full recoil/rearward position. Rather, bolt carrier group 230 and the remainder of timing group 240 are driven forward along rod 90 by drive spring 130, separating them from inertia weight 100.

Figure 5:
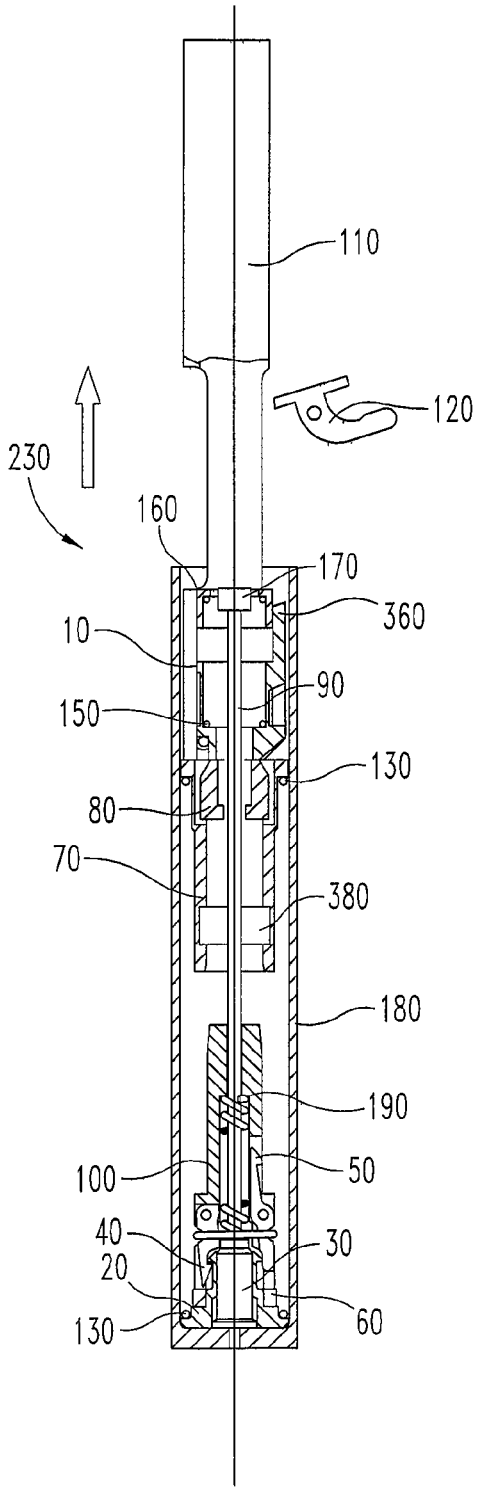
FIG. 5 is a partial section side view of the bolt carrier and rate reducer components of FIG. 3 moving toward battery with the inertia weight latched to the rear

FIG. 5 illustrates bolt carrier group 230 at a point in the cycle moving toward battery, with inertia weight 100 latched to base plate 20. Bolt carrier group 230, with buffer 70 and transfer button 80, are being driven forward by the expansion of drive spring 130.

Next, FIG. 6 shows bolt carrier group 230 fully in a forward/battery position. The front portion of timing group 240 is in the forward position, with the separated rear portion of timing group 240 having disengaged/unlatched from base plate 20, but not yet having begun to move forward.

FIGS. 6, 6A, 6B, 6C and 6D should be considered together for understanding the functional relationship between pull rod 90, transfer button 80, flange 170 and buffer 70, as the surface of buffer 70 that actuates pull rod 90, by way of flange 170, is obscured by button 80. Transfer button 80 is concentrically/slideably mounted to the forward end of buffer 70. Transfer button legs 280 are oriented to pass through transfer button leg slots 290 of buffer 70 and engage flange 170 on the forward end of pull rod 90. This engagement prevents transfer button 80 from falling out during field stripping. Transfer button legs 280 extend far enough rearward into transfer button leg slots 290 so that, when desired, inertia weight 100 can travel forward along rod 90, and within buffer 70, to impart transfer force to actuate transfer button 80.

Transfer button 80 is arranged to communicate/transfer force between inertia weight 100 and pusher 10 when inertia weight 100 travels forward. This communication/transfer link between bolt carrier group 230 and timing group 240 permits the rate control mechanism to exploit the substantial volume within receiver extension 180 (of M16 type firearms) while still actuating automatic sear 120 of the (crowded/separated) trigger/hammer/automatic sear group.

As the remainder of timing group 240 reaches the forward end of pull rod 90, buffer 70 contacts forward flange 170 of pull rod 90, moving the entire pull rod 90 forward so that shoulder 340 of rear pull rod head 30 impacts an inner edge 46 of weight latch 40 in a camming action to rotate and disengage weight latch 40 from groove 370 in base plate 20. This disengages inertia weight 100 from the rear of receiver extension 180. There may also be some additional compression of spring 190 as pull rod 90 moves forward. Inertia weight spring 190 presses forward on inertia weight 100 causing inertia weight 100 to accelerate forward according to the equation "force=mass×acceleration" (f=ma). The force load applied by inertia weight spring 190 and the mass of inertia weight 100 together determine the amount of time required for inertia weight 100 to travel forward and impact transfer button 80. The longitudinal translational movement of pull rod 90 is limited by the depth of a gap 22 defined between the rearward end of the receiver extension and the inside of base plate 20.

FIG. 7 illustrates bolt carrier group 230 fully in battery and an example mid-point position of inertia weight 100 moving forward under acceleration supplied by inertia weight spring 190. The time required for inertia weight 100 to travel forward from base plate 20 to impact with transfer button 80 determines the time added to the cyclic rate of the firearm 200 (of FIGS. 1 and 2). FIG. 7 shows weight latch 40 and buffer latch 50 returned to their resting positions by the compressive force of circular spring 270.

Bolt carrier group 230 and the remainder of timing group 240 are illustrated in FIG. 8 in a position almost fully into battery, where inertia weight 100 is still moving forward, but it has not yet impacted transfer button 80. As inertia weight 100 enters the rear of buffer 70, the rearward face of buffer 70 cams forward end 52 of buffer latch 50 counterclockwise (as illustrated) so that the forward end of latch 50 enters the interior of buffer 70 and slides along the inner diameter of buffer 70. When sufficiently advanced, forward end 52 of buffer latch 50 will engage internal annular recess 380 in buffer 70 as shown in FIG. 3. When inertia weight 100 arrives fully forward to an impact position, it will transfer force to transfer button 80, which in turn will move sear pusher 10 forward, which in turn will impact and trip sear 120, to fire the rifle. Generally, the kinetic energy possessed by inertia weight 100 exceeds the resistive force of pusher spring 150 and the inertial resistance of transfer button 80 and pusher 10, as well as the force required to trip sear 120. The system will have returned to the state illustrated in FIG. 3 when inertia weight 100 arrives fully forward, and the firing cycle may then be repeated.

An alternate embodiment is illustrated in FIGS. 9A-20. The alternate embodiment optionally adds an axial rotation or oscillating motion to the linear movement of the inertia weight as the inertia weight moves toward battery, which can be configured to control the amount of rate reduction. In the illustration shown, the oscillating motion effectively makes the inertia weight an oscillating flywheel escapement concurrently with its forward travel. In certain embodiments, the inertia weight/flywheel, in addition to accelerating forwardly, axially oscillates by axially rotating in one direction and then axially rotating in the opposite direction one or more times during at least a portion of the period the weight travels forward. These axial accelerations and decelerations can increase the cyclic rate reduction by adding more time into the cycle than if the inertia weight advances in a simple linear translation. Although not illustrated, other examples of oscillating motion could include a side-to-side or back and forth motion.

During translation movement along a pull rod usable in the second embodiment, the inertia weight/flywheel is permitted to accelerate forwardly (as in the previous embodiment) in order to impact the firing mechanism with sufficient force to reliably actuate the firing mechanism. However, during the forward motion, an oscillating axial rotation motion is introduced to increase the time delay. An aspect of increasing the time delay is that it allows a stronger inertia weight spring to be employed for a given cyclic rate reduction. Preferably, by using a stronger spring the assembly's sensitivity to firearm attitude, cleanliness, and environmental conditions is reduced, adding to the reliability of the firearm. With the exception of the aspects involved with oscillation motion, the structure, operation and functions of inertia weight/flywheel 440, weight latch 420, and buffer latch 430 illustrated in FIGS. 9A-20 are substantially similar and function in a substantially similar manner to inertia weight 100, weight latch 40 and buffer latch 50 and their respective components. FIGS. 9A-20 primarily illustrate the oscillating structure and function relative to the pull rod and inertia weight aspects. A bolt carrier group, essentially the same as bolt carrier group 230, is used in the oscillating embodiment, but is not illustrated in FIGS. 9A-20.

Figure 9A:
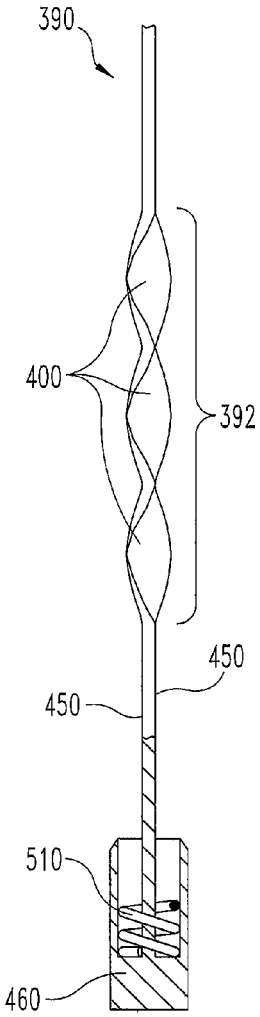
FIG. 9A is a partial sectional side view of an oscillator rod usable in an alternate rate reducer embodiment.
Figure 9B:
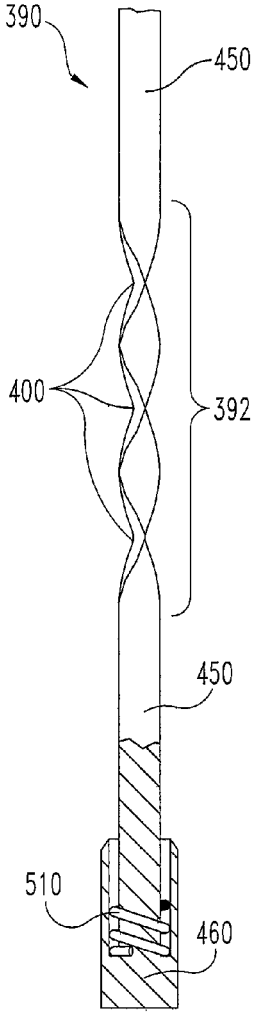
FIG. 9B is a partial view of the oscillator rod of FIG. 9A rotated 90 degrees.

Referring now to FIGS. 9A and 9B, the oscillating embodiment uses a variation of pull rod 90 illustrated as oscillator rod 390. A mid-portion of oscillator rod 390 defines an oscillating surface area 392, for example formed of angled lobe flats and edges in a generally helix shape. FIG. 9A is a side view of oscillator rod 390 showing a series of lobe flats 400 orientated to face the viewer of the figure. Flat sides 450 of oscillator rod 390 change orientation yet are parallel to each other throughout the length of oscillator rod 390. That is, lobe flats 400 and flat sides 450 have the same thickness throughout the length of oscillator rod 390. FIG. 9B shows oscillator rod 390 rotated 90 degrees compared to FIG. 9A to illustrate that flat sides 450 are parallel to (and equidistant from) each other throughout their length.

Figure 10:
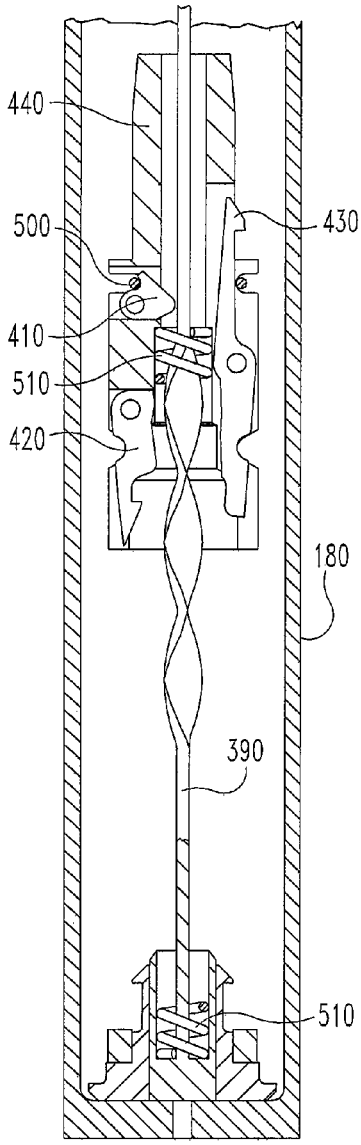
FIG. 10 is a sectional side view of selected components of an embodiment incorporating the oscillator rod of FIG. 9A.
Figure 11:
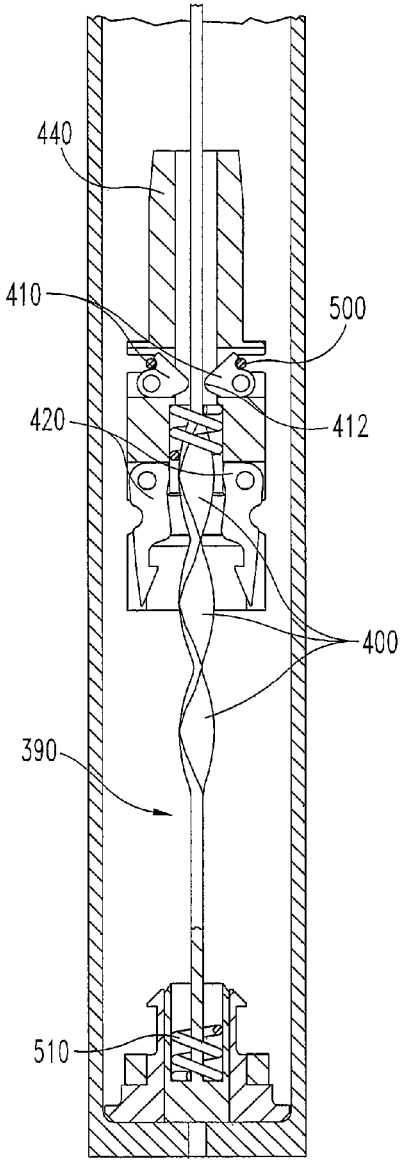
FIG. 11 is a sectional side view of the embodiment of FIG. 10 illustrating the oscillator lugs and oscillator weight latches within the inertia weight/flywheel.
Figure 12:
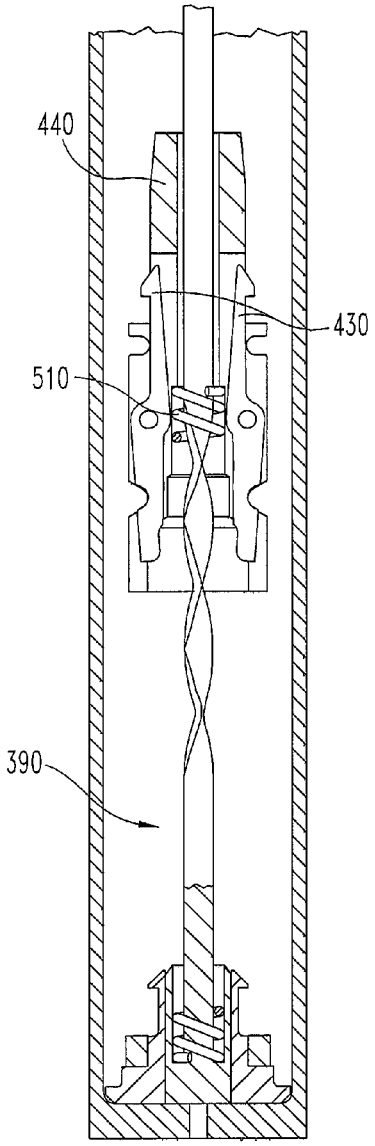
FIG. 12 is a view of the embodiment shown in FIG. 11 with the inertia weight/flywheel and oscillator rod rotated 90 degrees and illustrating the buffer latches.

FIGS. 10, 11 and 12 illustrate the relationships of weight latches 420 (and oscillator lugs 410) respective to buffer latches 430 (shown on inertia weight/flywheel 440). FIG. 10 is slightly altered for ease of conceptual reference by showing weight latches 420 in the same plane with buffer latches 430. In practice a pair of buffer latches 430 are typically displaced 90 degrees from a pair of weight latches 420 (and oscillator lugs 410) to provide symmetrical loading, more correctly illustrated in FIGS. 11 and 12.

In the illustrated embodiment, oscillator lugs 410 are mounted to inertia weight/flywheel 440. Oscillator lugs 410 are biased inwardly to rotationally engage oscillator rod 390, for example by circular spring 500. Oscillator lugs 410 have inward faces 412 that abut and engage surfaces of oscillator rod 390.

Figure 13A:
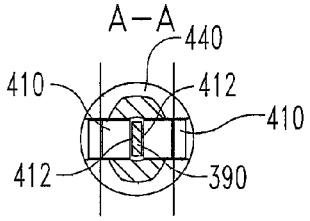
FIG. 13A illustrates the relationship of the oscillator lugs with the oscillator rod at the position shown in FIG. 13.
Figure 13:
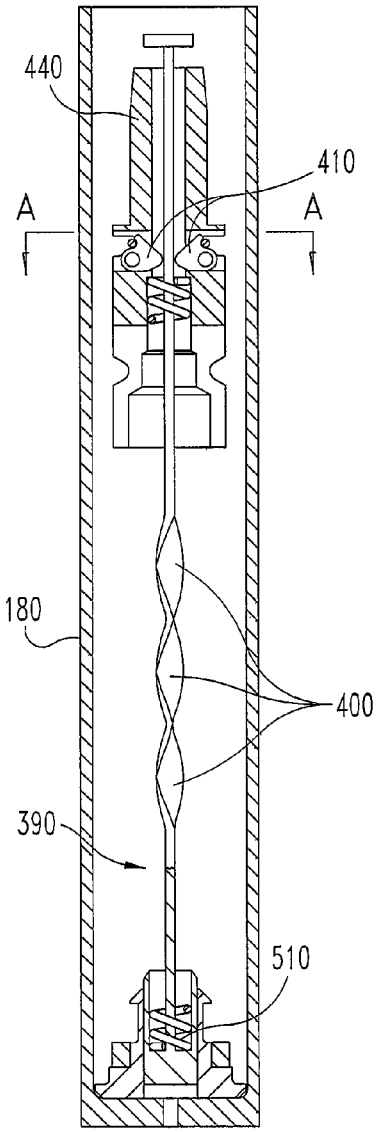
FIG. 13 is a sectional side view of selected components of the embodiment of FIG. 10 with the inertia weight/flywheel at rest in battery.

FIGS. 13 and 13A show inertia weight/flywheel 440 at rest in a forward/battery position. The timing group, weight latches and buffer latches have been left out for clarity in order to illustrate the relationship of oscillator lugs 410 to oscillator rod 390.

Figure 14A:
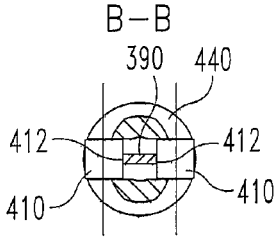
FIG. 14A illustrates the relationship of the oscillator lugs with the oscillator rod at the position shown in FIG. 14.
Figure 14:
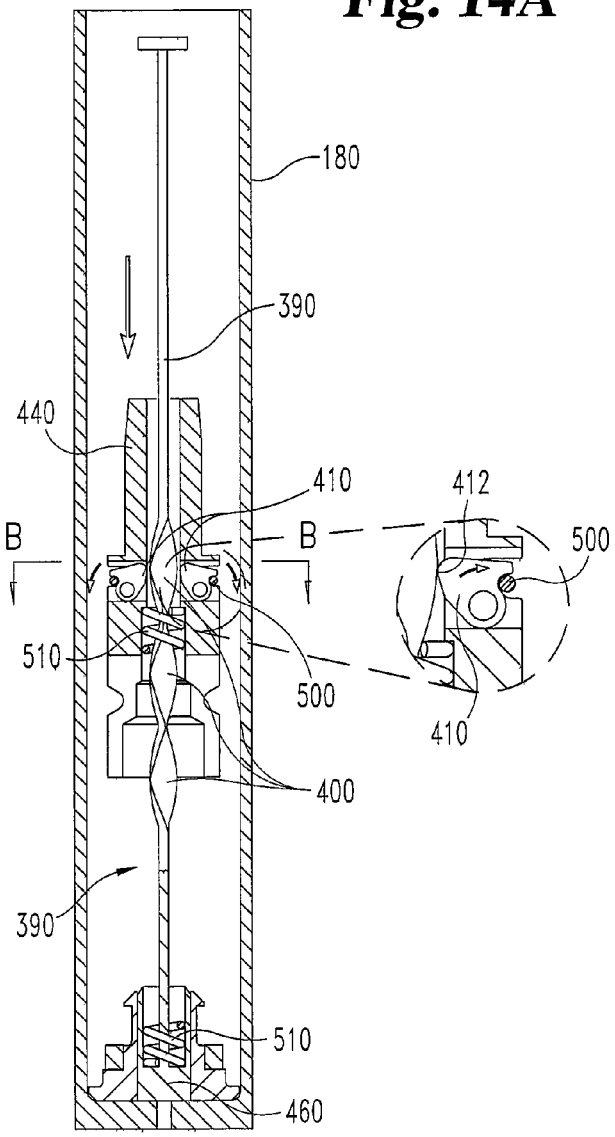
FIG. 14 is a sectional side view of the embodiment shown in FIG. 13 showing the inertia weight/flywheel during recoil.

FIGS. 14 and 14A show inertia weight/flywheel 440 moving rearward with oscillator lugs 410 rotated outwardly against the resistance of circular spring 500. (as illustrated in FIGS. 14 and 14A) such that inertia weight/flywheel 440 travels rearward without rotating/oscillating. The lugs may slightly bounce inward and outward between the lobe flats and the rod edges as the weight travels rearward. Preferably, the spring force provided by circular spring 500 allows lugs 410 to easily disengage from oscillating surface area 392 thereby allowing lugs 410 to bypass/override oscillating surface 392 when moving rearward.

At the point illustrated in FIG. 14, the entire timing group and bolt carrier group are traveling rearward as well, but only the inertia weight/flywheel 440 is shown, for clarity. Simultaneously, as the inertia weight travels rearward, inertia weight/flywheel spring 510 is compressed between inertia weight/flywheel 440 and a seat 460 in the base of oscillator rod 390. End coil portions of spring 510 are illustrated, with intermediate portions around rod 390 omitted for clarity.

Figure 15:
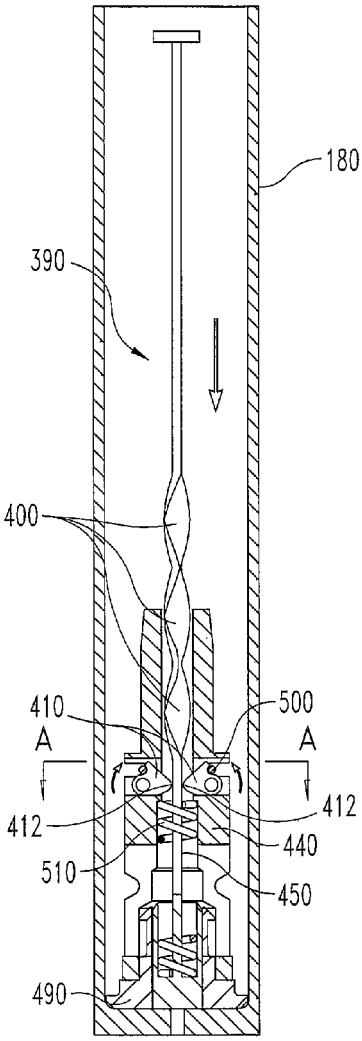
FIG. 15 shows the embodiment of FIG. 10 with the inertia weight/flywheel having moved fully rearward.
Figure 15A:
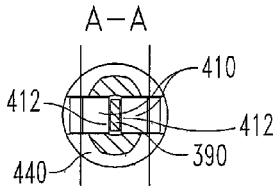
FIG. 15A illustrates the relationship of the oscillator lugs with the oscillator rod at the position shown in FIG. 15.

In FIG. 15 inertia weight/flywheel 440 has moved sufficiently rearward that oscillator lugs 410 have moved past the oscillating surface area and have been rotationally biased by spring 500 to engage flat sides 450 of rod 390. It would not be necessary for lobe flats 400 to transition into flat sides 450 at the rear of rod 390. However, rod 390 is represented (in the figures) this way to more clearly illustrate the relationship of lugs 410 and rod 390 in the drawings. Preferably, there is a slight clearance between oscillator lugs 410 and oscillator rod 390 so there is no pinch-binding between oscillator lugs 410 and inertia weight/flywheel 440 when inertia weight/flywheel 440 moves forwardly along rod 390. Additionally, despite being fully to the rear, the inertia weight/flywheel 440 has not yet fully compressed the inertia weight/flywheel spring 510. In same manner as discussed previously, inertia weight/flywheel spring 510 will be compressed slightly more when pull rod 390 is actuated when the forward portion of the timing group 240 (not shown) goes into battery (as occurs in the interim between what is illustrated in FIGS. 15 and 16).

At the recoil/rearward position, weight latches engage base plate 490 and buffer latches disengage inertia weight/flywheel 440 from the remainder of a timing group in a manner substantially comparable to the operation of weight latches 40, buffer latches 50 and timing group 240 at the rearward position discussed with respect to FIG. 4. The remainder of the timing group will then move forward. As the remainder of the timing group reaches the forward end of pull rod 390, comparable to FIG. 6, it moves the pull rod 390 forward, causing the weight latches to disengage from base plate 490. This disengages inertia weight 440 from the rear of receiver extension 180.

After weight 440 is disengaged, spring 510 begins urging inertia weight/flywheel 440 forward. As inertia weight/flywheel 440 travels forward along rod 390, the inward faces 412 of oscillator lugs 410 follow the surfaces of the oscillator rod 390. Lobe flats 400 (which can take the form of a helix or other shape) interact with oscillator lugs 410 to cause inertia weight/flywheel 440 to oscillate, for example rotationally along its longitudinal axis while inertia weight/flywheel 440 is concurrently moving forward. Since accelerating any object requires input of energy over time, the forward acceleration of inertia weight/flywheel 440 is retarded by axial oscillation as compared to the acceleration that would occur if there were only linear acceleration.

Figure 16A:
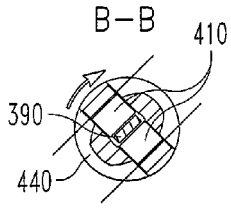
FIG. 16A illustrates the relationship of the oscillator lugs with the oscillator rod at the position shown in FIG. 16.
Figure 16B:
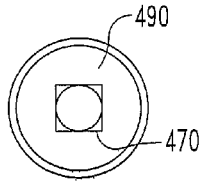
FIG. 16B is a rear view of the base plate of the embodiment of FIG. 10.
Figure 16C:
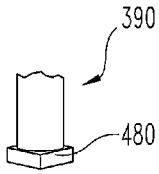
FIG. 16C is a perspective view of the base of the oscillator rod of the embodiment of FIG. 16.
Figure 16:
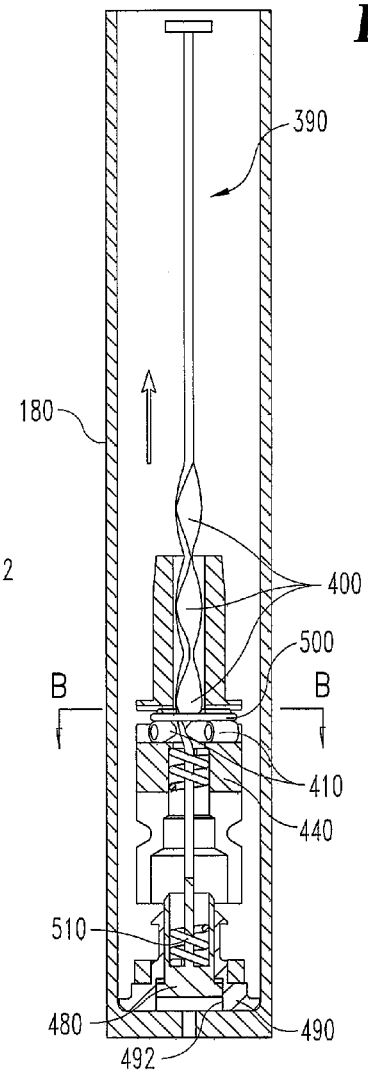
FIG. 16 shows the embodiment of FIG. 10 with the inertia weight/flywheel having rotated axially approximately 45 degrees, while beginning to move toward battery.

In the illustrated position of FIGS. 16 and 16A, the inertia weight has moved sufficiently forward for oscillator lugs 410 to contact the first helical surface of lobe flats 400 causing inertia weight/flywheel 440 to rotate (for example clockwise from the perspective of FIG. 16A).

The cross-sectional view of FIG. 16A shows the positions of oscillator lugs 410 relative to inertia weight/flywheel 440, and oscillator rod 390 at the position illustrated in FIG. 16. As illustrated, inertia weight/flywheel 440 has rotated, for example approximately 45 degrees in one direction (for example clockwise from the perspective of FIG. 16A) around the axis of rod 390, by the interaction of oscillator lugs 410 with oscillator rod 390.

A splined and slideable fit between square head 480 of oscillator rod 390 and square passage 492 of base plate 490 permits oscillator rod 390 to move longitudinally relative to base plate 490, but prevents oscillator rod 390 from rotating relative to base plate 490. Specifically, when oscillator lugs 410 contact lobe flats 400 and cause inertia weight/flywheel 440 to rotate, a reactive torque is applied to oscillator rod 390. In a variation from pull rod 90 illustrated in FIG. 4, the base of oscillating rod 390 has a splined fit with the base plate, for example with a square head 480 as illustrated in FIG. 16C. Square head 480 fits slideably within a passage 492 in base plate 490 which has a square cross-section 470, as illustrated from a rear view in FIG. 16B. Pull rod 390 and head 480 can move freely forward and backward a short distance as defined by the depth of passage 492. A portion of rod 390 forward of square head 480 is round and fits within the circular cross-sectional hole defined in base plate 490 as shown in FIG. 16B. The circular cross-section prevents square head 480 from pulling out of the base plate 490. Base plate 490 is held rearward by the drive spring (not shown) and is prevented from turning, typically due to friction between base plate 490 and receiver extension 180. Alternately, other shapes that slideably spline base plate 490 with the rear end of oscillator rod 390 can be employed.

Figure 17A:
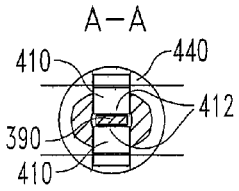
FIG. 17A illustrates the relationship of the oscillator lugs with the oscillator rod at the position shown in FIG. 17.
Figure 18A:
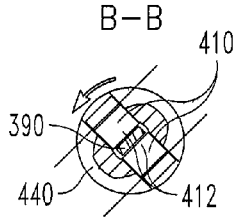
FIG. 18A illustrates the relationship of the oscillator lugs with the oscillator rod at the position shown in FIG. 18.
Figure 17:
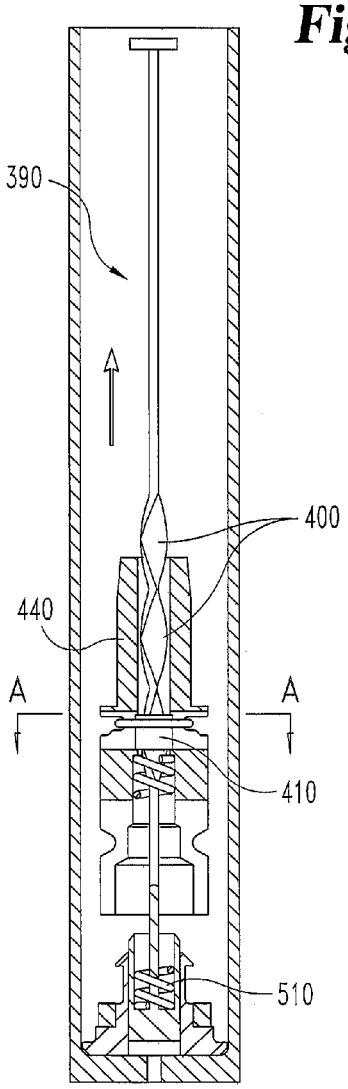
FIG. 17 illustrates the inertia weight/flywheel at its point of maximum rotation, which is 45 degrees from the view shown in FIG. 16 and 90 degrees from the view shown in FIG. 15.
Figure 18:
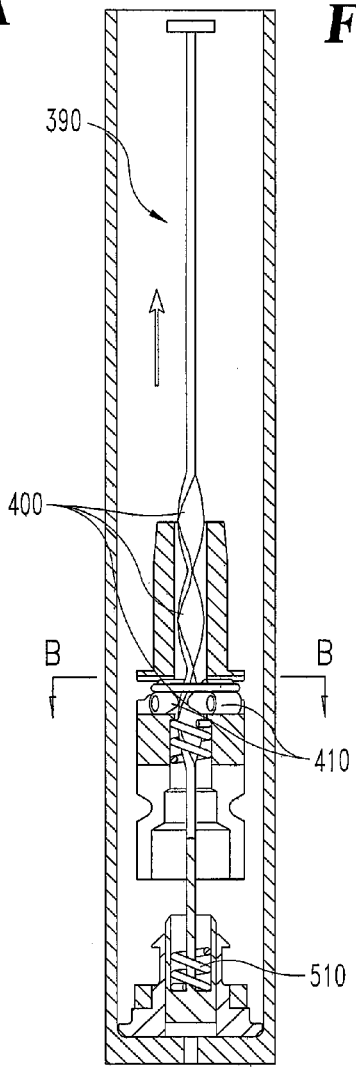
FIG. 18 illustrates the inertia weight/flywheel moving forward and rotating in the opposite direction from the view shown in FIG. 16.
Figure 19:
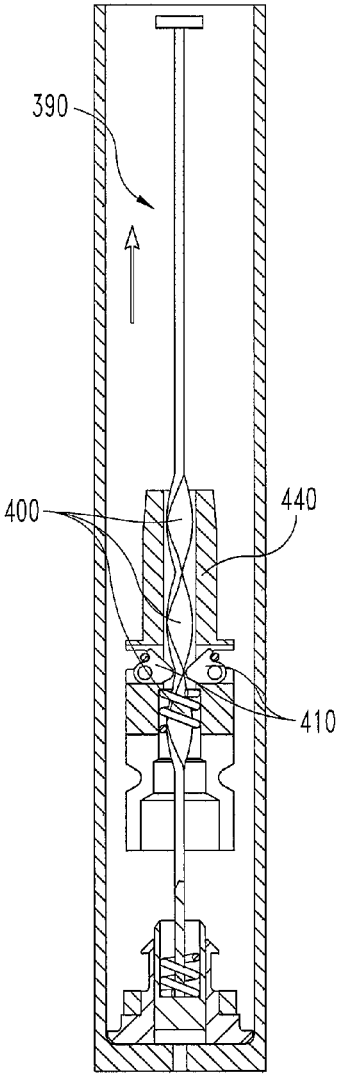
FIG. 19 shows the embodiment of FIG. 10 with the inertia weight/flywheel having moved far enough forward to have completed one full oscillation cycle.

FIGS. 17 and 17A show inertia weight/flywheel 440 continuing to move forward, but inertia weight/flywheel 440 and lugs 410 have moved to a maximum rotation position (e.g. clockwise 45 degrees from FIG. 16, and 90 degrees from FIG. 15). The axial rotation of inertia weight/flywheel 440 then reverses direction. FIGS. 18 and 18A show the rotation of inertia weight/flywheel 440 having reversed its axial rotation, (e.g. 45 degrees counter-clockwise from the perspective of FIG. 17 returning to the rotational orientation of FIG. 16), yet continuing in forward linear motion. FIG. 19 shows inertia weight/flywheel 440 continuing forward but with inertia weight/flywheel 440 having momentarily returned to a zero axial rotation position (preceding another oscillation).

A non-limiting example with three lobe flats and approximately 90 degrees of axial rotation is shown. Alternately, more or fewer lobe flats may be used and the angle, shape and length of the lobe flats can be varied. For example, the lobe flats/oscillations could be continued over the full length of rod 390, if so desired. Alternately, the inertia weight could follow a spiral track or a partial spiral track to rotate more or less than 90 degrees, for example equal to or greater than 180 or 360 degrees; however, preferably angular rotation of the weight is decelerated or stopped at least once during forward motion to interrupt the weight's angular momentum. The time it takes for an inertia weight/flywheel to go through the oscillating motion can be selectively controlled by varying/selecting the mass of the weight, the spring force and the number, angle, length and shape of the lobe flats in the oscillating surface area of the pull rod.

Figure 20:
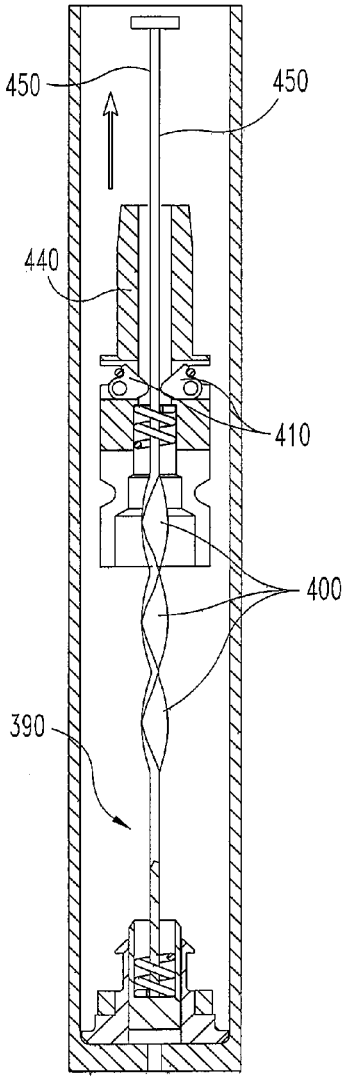
FIG. 20 shows the embodiment of FIG. 10 with the inertia weight/flywheel having moved far enough forward so that the oscillator lugs are clear of the lobes of the oscillator rod, and the inertia weight/flywheel is moving straight forward.

Preferably, the oscillation process ends when lugs 410 travel forward past the oscillation surface area 392, as illustrated in FIG. 20. When oscillator lugs 410 are forward of lobe flats 400, lugs 410 follow flat sides 450 of rod 390 and inertia weight flywheel 440 is free to accelerate linearly along oscillator rod 390 to impact transfer button 80 as shown in FIGS. 3 through 8.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of reducing the cyclic rate of a self-powered firearm, comprising:

allowing a timing group assembly to travel rearward relative to a pull rod within a receiver extension of a self-powered firearm upon an initial recoil action;

retaining an inertia weight of the timing group assembly at a rearward position within the receiver extension while disengaging the inertia weight from the remainder of the timing group;

urging the remainder of the timing group to travel forward relative to the pull rod;

advancing the pull rod to disengage the inertia weight from the rearward end of the receiver extension;

urging the disengaged inertia weight to travel forward within the receiver extension; and, allowing the inertia weight to travel forward to an impact position wherein said inertia weight communicates force forward sufficient to actuate a sear to fire the firearm.

2. The method of claim 1, comprising: allowing a bolt carrier group to travel rearward and forward with said timing group.

3. The method of claim 2, comprising applying a resistive force to prevent a sear pusher of said bolt carrier group from tripping the sear of the firearm as the bolt carrier group moves forward.

4. The method of claim 3, wherein the forward movement of said inertia weight applies a force to said sear pusher of said bolt carrier group which exceeds the resistive force sufficiently such that said sear pusher trips said sear to fire the firearm.

5. The method of claim 1, comprising latching said inertia weight in said forward position to said timing group.

6. The method of claim 1, comprising selectively choosing a mass of said inertia weight and the force associated with an inertia weight spring used to bias the inertia weight to travel forward, to selectively control the amount of time said inertia weight takes to travel from said rearward position to said forward impact position.

7. The method of claim 1, wherein said advancing the pull rod to disengage the inertia weight from the rearward end of the receiver extension occurs by the remainder of the timing group impacting a forward portion of the pull rod.

8. The method of claim 1, comprising causing said inertia weight to oscillate during at least a portion of the period it travels forward.

9. The method of claim 8, comprising causing said inertia weight to oscillate by axially rotating in one direction and then axially rotating in the opposite direction during at least a portion of the period the weight travels forward.

10. A cyclic rate reduction assembly for a self-powered firearm, comprising:

a timing group having an inertia weight arranged within a receiver extension of a self-powered firearm;

a pull rod arranged within the receiver extension, wherein said timing group can selectively translate rearward relative to said pull rod during a recoil stage of the firearm;

a weight latch mechanism to retain said inertia weight of said timing group at a rearward position within the receiver extension while disengaging the inertia weight from the remainder of the timing group;

a drive biasing element urging the remainder of said timing group to travel forward relative to the pull rod at the end of the recoil stage;

wherein said timing group impacts a forward end of the pull rod during said forward movement causing said pull rod to move forward;

wherein said pull rod includes a rear portion which causes said weight latch mechanism to disengage said inertia weight from the rearward end of the receiver extension when said pull rod moves forward; and, a weight biasing element urging said disengaged inertia weight to move forward to an impact position to communicate force forward to actuate a sear to fire the firearm.

11. The assembly of claim 10, comprising a buffer latch mechanism which is operable to engage said inertia weight in said forward position to the remainder of said timing group.

12. The assembly of claim 10, wherein said inertia weight engages an oscillating surface area defined on said pull rod which causes said inertia weight to oscillate relative to the pull rod during at least a portion of the forward motion of said weight.

13. The assembly of claim 12, wherein said oscillating surface area comprises at least one angled lobe flat.

14. The assembly of claim 10, wherein a base plate and the rearward end of the receiver extension define a gap depth and wherein the distance of forward and rearward motion of said pull rod is limited by said gap depth.

15. The assembly of claim 14, wherein a weight latch mechanism engages said base plate to retain said inertia weight at the rearward end of the receiver extension.

16. The assembly of claim 15, wherein said pull rod includes a shoulder on said rear portion and wherein said shoulder impacts said weight latch mechanism in a camming action to disengage said inertia weight when said pull rod moves forward.

17. A self-powered firearm incorporating a cyclic rate reduction assembly, comprising:

a self-powered firearm having a receiver extension and having a sear element which can be tripped to fire the firearm during automatic fire;

a timing group initially arranged within a forward portion of said receiver extension and having an inertia weight, wherein said timing group can translate rearwardly against a drive biasing element during a recoil stage of the firearm;

a pull rod arranged within said receiver extension, a latch mechanism arranged to retain said inertia weight at a rearward position within the receiver extension while disengaging the inertia weight from the remainder of the timing group and wherein said biasing element urges the remainder of said timing group to translate forward without said inertia weight;

wherein said timing group impacts a forward end of the pull rod during said forward movement whereupon the pull rod translates force to a rear portion which disengages said latch mechanism; and, a weight biasing element urging said inertia weight to move forward sufficiently to communicate force forward to trip said sear.

18. The assembly of claim 17, comprising a bolt carrier group arranged between said timing group and said sear of said firearm, wherein a gap is defined between a sear pusher element of said bolt carrier group and said sear.

19. The assembly of claim 18, comprising a pusher spring which applies sufficient rearward force against said sear pusher in said bolt carrier group as said bolt carrier group moves forward to prevent said sear pusher element from tripping said sear prior to the impact of said inertia weight.

20. The assembly of claim 17, wherein said inertia weight engages an oscillating surface area defined on said pull rod which causes said inertia weight to oscillate relative to the pull rod during at least a portion of the forward motion of said weight.

* * * * *